US009523500B2

(12) United States Patent
Katefidis

(10) Patent No.: US 9,523,500 B2
(45) Date of Patent: Dec. 20, 2016

(54) THERMAL AFTERBURNING SYSTEM AND METHOD FOR OPERATING SUCH A SYSTEM

(75) Inventor: Apostolos Katefidis, Gaertringen (DE)

(73) Assignee: EISENMANN AG, Boeblingen (DE)

( * ) Notice: Subject to any disclaimer, the term of this patent is extended or adjusted under 35 U.S.C. 154(b) by 333 days.

(21) Appl. No.: 14/346,599

(22) PCT Filed: Sep. 6, 2012

(86) PCT No.: PCT/EP2012/003737
§ 371 (c)(1),
(2), (4) Date: Jun. 13, 2014

(87) PCT Pub. No.: WO2013/041185
PCT Pub. Date: Mar. 28, 2013

(65) Prior Publication Data

US 2014/0322657 A1 Oct. 30, 2014

(30) Foreign Application Priority Data

Sep. 23, 2011 (DE) ..... 10 2011 114 292

(51) Int. Cl.
*F23G 7/06* (2006.01)
*F23N 1/00* (2006.01)
*F23N 5/00* (2006.01)

(52) U.S. Cl.
CPC ..... *F23G 7/065* (2013.01); *F23N 1/002* (2013.01); *F23N 5/003* (2013.01); *F23N 2025/21* (2013.01);
(Continued)

(58) Field of Classification Search
CPC ..... F23N 1/002; F23N 1/005
(Continued)

(56) References Cited

U.S. PATENT DOCUMENTS 4,101,632 A * 7/1978 Lamberti ..... B01D 53/62 110/345
5,160,259 A * 11/1992 O'Hara ..... F23N 1/042 236/15 E
(Continued)

FOREIGN PATENT DOCUMENTS

DE 22 47 016 A 3/1974
DE 35 27 835 A1 2/1987
(Continued)

*Primary Examiner* — Avinash Savani
(74) *Attorney, Agent, or Firm* — Factor Intellectual Property Law Group, Ltd.

(57) ABSTRACT

A thermal afterburning system and a method for operating such a system are described, in which method or system a burner gas is fed in a conventional manner to a burner heating the combustion space of a combustion chamber, and exhaust air with a pollutant load is fed to the combustion space of the combustion chamber. The clean air produced inside the combustion space during the combustion processes is discharged. At the same time the carbon monoxide content of said air is measured. The supply of burner gas to the burner is regulated in such a manner that a predetermined target value for the carbon monoxide content is maintained. In this manner, the temperature in the combustion space is kept only sufficiently high as is required to achieve the desired purity of the clean gas given the respective pollutant load of the exhaust air.

4 Claims, 1 Drawing Sheet

(52) U.S. Cl.
CPC .. *F23N 2041/18* (2013.01); *F23N 2900/05001* (2013.01)

(58) Field of Classification Search
USPC ..... 431/22, 76, 5, 12
See application file for complete search history.

(56) References Cited

U.S. PATENT DOCUMENTS

| | | | | |
|---|---|---|---|---|
| 5,540,886 | A | 7/1996 | Warmbier et al. | |
| 5,662,049 | A * | 9/1997 | Shimizu | F23G 5/16 110/245 |
| 2002/0033125 | A1 | 3/2002 | Cochran et al. | |
| 2006/0204911 | A1* | 9/2006 | Teng | F23N 1/022 431/76 |
| 2011/0039216 | A1 | 2/2011 | Geiger | |

FOREIGN PATENT DOCUMENTS

| | | | |
|---|---|---|---|
| DE | 42 22 469 | C1 | 1/1994 |
| WO | 2009/130180 | A2 | 10/2009 |

* cited by examiner

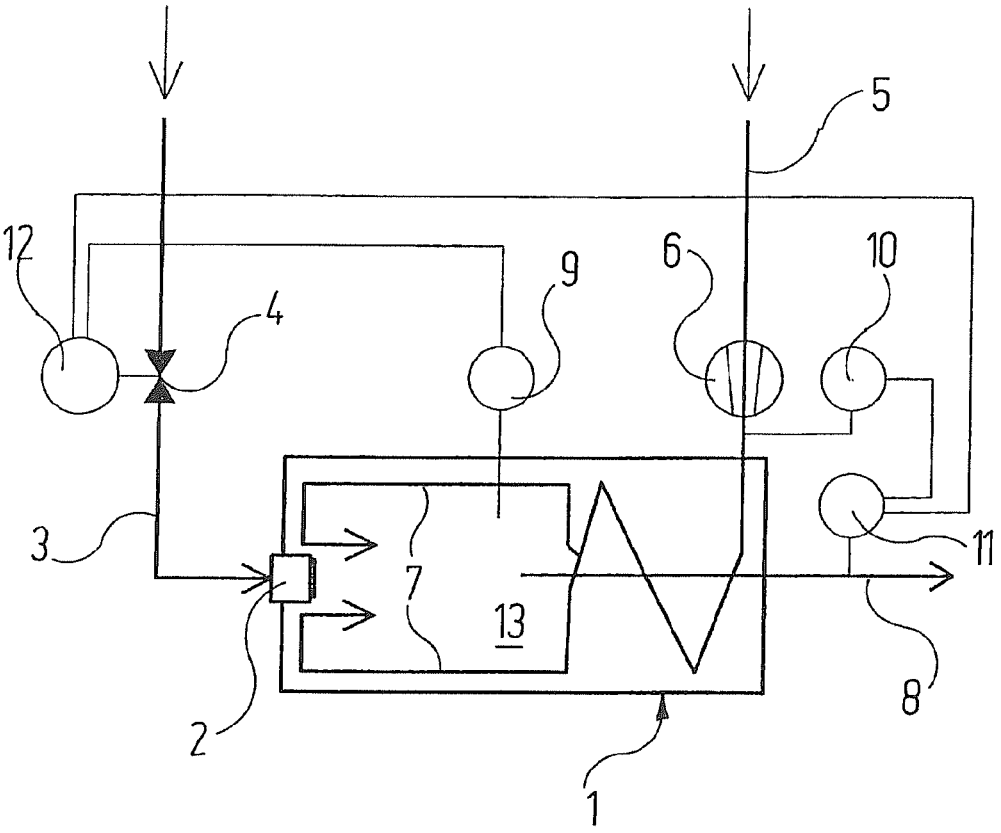
5
12
9
6
10
4
3
7
13
11
2
8
1

THERMAL AFTERBURNING SYSTEM AND METHOD FOR OPERATING SUCH A SYSTEM

RELATED APPLICATIONS

This application is a national phase of International Patent Application No. PCT/EP2012/003737, filed Sep. 6, 2012, which claims the filing benefit of German Patent Application No. 10 2011 114 292.8, filed Sep. 23, 2011, the contents of both of which are incorporated herein by reference.

FIELD OF THE INVENTION

The invention relates to a thermal afterburning system having a) a combustion chamber, which for its part comprises:
   aa) a combustion space;
   ab) a burner capable of heating the combustion space of the combustion chamber;
   ac) an inlet for pollutant-containing exhaust air;
   ad) an outlet for clean air;
b) a supply line, via which the burner is feedable with burner gas;
c) a gas regulating valve in the supply line;
d) an outlet line, via which the clean gas is dischargeable;
e) a control device which controls the gas regulating valve for setting a desired temperature in the combustion space;

and to a method for operating a thermal afterburning system, in which a) burner gas is fed to a burner heating a combustion space of a combustion chamber;
b) pollutant-laden exhaust air is fed to the combustion space of the combustion chamber;
c) clean gas is discharged from the combustion space of the combustion chamber.

BACKGROUND OF THE INVENTION

In the case of known thermal afterburning systems and methods of the initially mentioned type as are currently found on the market, the procedure is as follows: In the case of the maximum expected and permitted load of the exhaust air, the temperature is determined at which the clean air has the desired purity, in particular a specific maximum value of the carbon monoxide content. This temperature is then constantly regulated during the operation of the thermal afterburning system, regardless of the pollutant load that the supplied exhaust air actually has. Over long operating periods, this generally results in a higher temperature being produced in the combustion space of the combustion chamber than would really be necessary to achieve the desired purity in view of the currently prevailing pollutant load of the exhaust air.

SUMMARY OF THE INVENTION

An object of the present invention is to provide a thermal afterburning system and a method for its operation of the initially mentioned type, in which system and method a more cost-effective and gentler operation of the combustion chamber is possible.

This object may be achieved, with regard to the thermal afterburning system itself, in that f) in the outlet line there is provided a carbon monoxide sensor which generates an output signal representative of the carbon monoxide content of the clean gas and feedable to the control device;
g) in the control device there is storable a target value for the carbon monoxide content of the clean air;
h) the control unit being programmed such that in the event of a deviation of the actual value measured by the carbon monoxide sensor from the target value of the carbon monoxide content of the clean air, the gas regulating valve is adjusted such that in the combustion space of the combustion chamber a temperature is set at which the actual value corresponds to the target value.

According to the invention, the combustion space temperature is therefore not regulated to a fixed, maximum value; rather the regulation of the combustion space temperature is secondary to the emission values required for the clean gas. In this way, under all operating conditions, particularly therefore different loads of the processed exhaust air, the optimum combustion chamber temperature is automatically set. If a lot of pollutants are present in the supplied exhaust air, in accordance with the production processes in the process steps preceding the thermal afterburning system, the combustion space temperature is increased to prevent an increase in the emission values in the clean gas. Conversely, if in the preceding process steps or even in rest periods fewer or even no pollutants arise in the supplied exhaust air, the combustion space temperature is reduced and thus adapted to the pollutant content in the exhaust air.

Owing to the lower average temperatures which are set in the combustion space of the thermal afterburning system according to the invention, not only energy is saved; the materials used there are also conserved, which extends the service life of the system.

In the configuration of the thermal afterburning system according to the invention, a reduction of the pollutant load of the supplied exhaust air results, as already mentioned above, in a lower temperature in the combustion space. This accordingly also results in a lower temperature of the discharged clean air. This is highly desirable since, in the case of a lower production or in rest periods of the entire process line, also less energy is required in the system parts supplied by the afterburning system.

In a particularly preferred embodiment of the invention, a pollutant sensor is provided, which measures the load of the supplied exhaust air with pollutants and in the event of a change of the load modifies the target value stored in the control device and/or the output signal delivered by the carbon monoxide sensor such that the temperature in the combustion space of the combustion chamber is changed in advance in the direction which is required to maintain the target value of the carbon monoxide content in the clean gas.

This configuration of the invention is explained as follows: Owing to the fact that, according to the invention, the combustion space temperature is regulated primarily according to the carbon monoxide content in the discharged clean gas, in the case of pronounced changes in the load of the processed exhaust air there may result for regulating reasons an over- or undershooting of the pollutant content in the clean air. To prevent this, the pollutant load of the exhaust air is measured already on the admission of the latter to the combustion chamber and the combustion space temperature already at this point in time is changed in such a direction as is required to maintain the desired emission values in the clean air. The extent to which a particular change in the load of the exhaust air necessitates this advance change of the combustion space temperature can be determined by simple experiments and, for example by means of a corresponding characteristic curve, can be stored in the control device.

Expediently, in this latter configuration of the invention, the modification of the target value stored in the control device and/or of the output signal of the carbon monoxide sensor is reversible again after a certain period of time. The modification of the target value and/or of the control signal is merely intended to minimise regulating variations in the carbon monoxide content of the clean gas due to sluggishness. Such regulating variations, however, no longer occur some time after the occurrence of the change in the exhaust air load, so that an adjustment of the combustion space temperature in advance is no longer required.

Alternatively, and for the same reason, a temperature-controlled reversal of the modification is possible, namely in such a way that the modification takes place only when the temperature in the combustion space of the combustion chamber is below a certain value, in particular below 700° C.

The above-mentioned object may be achieved, with regard to the method for operating a thermal afterburning system, in that d) the carbon monoxide content in the clean gas is measured;

e) the supply of burner gas to the burner is regulated such that a predetermined target value for the carbon monoxide content in the clean gas is maintained.

The advantages of this method correspond analogously to the above-explained advantages of a thermal afterburning system according to the invention.

Expediently, the pollutant load in the exhaust air fed to the combustion space is measured and, in the event of changes of the load, the supply of burner gas to the burner is changed in advance in such a manner as is expected to be required to maintain the target value of the carbon monoxide content in the clean gas. Also the purpose of this measure and the advantages hereby mentioned have already been explained above.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

An exemplary embodiment of the invention is explained in more detail below with reference to the drawing; the single FIGURE shows the layout of a thermal afterburning system.

DETAILED DESCRIPTION OF THE PRESENT INVENTION

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

The main component of the thermal afterburning system is a combustion chamber 1, inside which there is a combustion space 13. This space or the atmosphere contained in it can be heated to a desired temperature with the aid of a burner 2. For this purpose, burner gas is fed to the burner 2 via a line 3. In this line 3 there is a gas regulating valve 4, which is controlled in a manner to be described later.

The combustion chamber 1 is further fed, via a line 5 by means of a blower 6, with the exhaust air laden with pollutants which is to be cleaned. The exhaust air is introduced via an internal line system 7 inside the combustion chamber 1, the detailed design of which is not important here, into the combustion space 13 and there into the flame produced by the burner 2. There the pollutants in the exhaust air are burned. The clean gases thus produced are supplied via a line 8 to a heat consumer. Finally, they can then be released into the outside atmosphere.

As described thus far, the construction of the thermal afterburning system corresponds to that according to the prior art.

What does not correspond to the prior art any more is the way in which various operating parameters of the thermal afterburning system are monitored with various sensors:

A temperature sensor 9 measures the operating temperature prevailing in the combustion space 13. A pollutant sensor 10 detects the load of the exhaust air with pollutants, especially hydrocarbons, which is fed through the line 5 to the combustion space 13. Finally, a carbon monoxide sensor 11 measures the carbon monoxide content of the clean gas flowing via the line 8.

The output signals of the temperature sensor 9, the pollutant sensor 10 and the carbon monoxide sensor 11 are fed to a control device 12. The control device 12 determines the degree of opening of the gas regulating valve 4 according to the following logic:

In the control device 12 there is stored a target value for the carbon monoxide content in the line 8. If the actual value of the carbon monoxide content in the line 8 measured by the carbon monoxide sensor 11 exceeds this target value, this would mean that the operating temperature inside the combustion space 13 is not yet sufficient. The control device 12 now opens the gas regulating valve 4 a little further, so that the burner 2 brings the combustion space 13 of the combustion chamber 1 to a somewhat higher operating temperature. At this temperature, the carbon monoxide content of the clean gas then decreases, for the same residence time of the gases within the combustion space 13, until the content of carbon monoxide in the line 8 detected by the carbon monoxide sensor 11 corresponds to the stored target value again.

Conversely, if the carbon monoxide sensor 11 detects that the carbon monoxide content in the line 8 falls below the predetermined target value, the control device 12 reduces the supply of burner gas to the burner 2 by closing the gas regulating valve 4 a little further. The result is that the operating temperature in the combustion space 13 of the combustion chamber 1 decreases and the content of carbon monoxide in the clean gas increases until the desired carbon monoxide content in the line 8 is then detected again by the carbon monoxide sensor 11.

With the aid of the temperature sensor 9, the respective operating temperature in the combustion space 13 is determined and, provided that it does not have to be changed owing to signals of the carbon monoxide sensor 11, is maintained at the desired value by means of the control device 12.

In the above description of the functioning of the thermal afterburning system the pollutant sensor 10 has been disregarded so far. This sensor is not required as long as the load of the exhaust air, flowing in via the line 5, with impurities does not vary greatly. If there are sudden changes in the load of this exhaust air, however, the regulation of the operating temperature on the basis of the output signal of the carbon monoxide sensor 11 alone could be too sluggish. This could then result, in particular, in a short-term overshooting of the carbon monoxide content in the line 8 until, by increasing the output of the burner 2, the operating temperature reached in the combustion space 13 is that which is required to achieve the desired carbon monoxide content in the line 8 given the higher level of pollutants in the exhaust air.

In such a case, the pollutant sensor 10 now intervenes. This sensor can detect, even before the entry of the pollutant-laden exhaust air into the combustion space 13, that shortly a greater burner output will be required. In order now to avoid the delay associated with the measurement of the carbon monoxide content in the line 8 by the carbon monoxide sensor 11, the pollutant sensor 10 delivers to the carbon monoxide sensor 11 a signal which influences the output signal of the latter so that it simulates a higher carbon monoxide content than that which is actual measured. The control device 12 now interprets the output signal of the carbon monoxide sensor 11 as though the carbon monoxide content in the line 8 were actually too high, and correspondingly increases the supply of burner gas to the burner 2 with the aid of the gas regulating valve 4 and, in consequence, the operating temperature in the combustion space 13. When the exhaust air laden with more pollutants now arrives in the combustion space 13, it encounters here an operating temperature which is already higher or at least already rising, so that the conditions are already provided for increased combustion of pollutants in the combustion space 13.

The displacement of the output signal of the carbon monoxide sensor 11 can be reversed after a certain transition period, so that the control device 12 again compares the true actual value of the carbon monoxide content in the line 8 with the stored target value and regulates the operating temperature in the combustion space 13 accordingly.

As an alternative to the modification of the output signal of the carbon monoxide sensor 11, the target value stored in the control device 12 can also be displaced by the output signal of the pollutant sensor 10. This is done in the direction which results in an increase of the operating temperature in the combustion space 13 in the case of an increased pollutant load of the exhaust air, and vice versa.

Finally, the following procedure is also possible: Instead of coupling the reversal of the modification to a fixed period of time, this can also be effected in a temperature-controlled manner. If the temperature sensor 9 signals in the combustion space 13 that a sufficiently high temperature exists there, the advance control by the pollutant sensor 10 may be omitted or cancelled. As a sufficiently high temperature, in particular approximately 700° C. is suitable, because just below this value lies the temperature at which the oxidation of CO to $CO_2$ begins.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. Thermal afterburning system comprising:

a) a combustion chamber, which comprises aa) a combustion space;

ab) a burner capable of heating the combustion space;

ac) an inlet for pollutant-containing exhaust air;

ad) an outlet for clean air;

b) a supply line, via which the burner is feedable with a burnable gas;

c) a gas regulating valve in the supply line;

d) an outlet line, via which the clean gas is dischargeable;

e) a control device which controls the gas regulating valve for setting a desired temperature in the combustion space;

wherein f) in the outlet line there is provided a carbon monoxide sensor which generates an output signal representative of a carbon monoxide content of the clean gas and feedable to the control device;

g) in the control device there is storable a target value for the carbon monoxide content of the clean air;

h) the control device being programmed such that in the event of a deviation of an actual value measured by the carbon monoxide sensor from the target value of the carbon monoxide content of the clean air, the gas regulating valve is adjusted such that in the combustion space of the combustion chamber a temperature is set at which the actual value corresponds to the target value, the system further comprising a pollutant sensor which measures a load of the pollutant-containing exhaust air, and in the event of a change of the load, modifies the target value stored in the control device and/or the output signal delivered by the carbon monoxide sensor such that the temperature in the combustion space of the combustion chamber is changed in advance in a direction which is required to maintain the target value of the carbon monoxide content in the clean gas.

2. Thermal afterburning system according to claim 1, wherein the modification of the target value stored in the control device and/or of the output signal of the carbon monoxide sensor is reversible again after a certain period of time.

3. Thermal afterburning system according to claim 1, wherein the modification of the target value stored in the control device and/or of the output signal of the carbon monoxide sensor takes place only when the temperature in the combustion space of the combustion chamber is below a certain value, in particular below approximately 700° C.

4. Method for operating a thermal afterburning system, comprising:

a) feeding burner gas to a burner heating a combustion space of a combustion chamber;

b) feeding pollutant-laden exhaust air to the combustion space of the combustion chamber;

c) discharging clean gas from the combustion space of the combustion chamber;

wherein d) the carbon monoxide content in the clean gas is measured;

e) the supply of burner gas to the burner is regulated such that a predetermined target value for the carbon monoxide content in the clean gas is maintained, and further wherein a pollutant load in the exhaust air fed to the combustion space is measured and, in the event of a change of the pollutant load, the burner gas fed to the burner is changed in advance in such a manner as is expected to be required to maintain the predetermined target value of the carbon monoxide content in the clean gas.

* * * * *